United States Patent [19]

Teramoto

[11] 4,182,109

[45] Jan. 8, 1980

[54] CALENDAR MECHANISM FOR TIMEPIECES

[75] Inventor: Kazuo Teramoto, Fuchu, Japan

[73] Assignee: Citizen Watch Co., Ltd., Tokyo, Japan

[21] Appl. No.: 927,399

[22] Filed: Jul. 24, 1978

[30] Foreign Application Priority Data

Aug. 22, 1977 [JP] Japan ..... 52-100327

[51] Int. Cl.[2] ..... G04B 19/24

[52] U.S. Cl. ..... 58/4 R; 58/58

[58] Field of Search ..... 58/4 R, 4 A, 5, 57, 58/58, 59, 85.5, 125 R, 125 B, 126 R, 126 A, 23 R

[56] References Cited

U.S. PATENT DOCUMENTS

| | | | |
|---|---|---|---|
| 3,477,222 | 11/1969 | Zeung et al. | 58/4 A |
| 3,673,789 | 7/1972 | Tsuzuki et al. | 58/58 |
| 3,716,983 | 2/1973 | Tanaka et al. | 58/58 |
| 3,827,234 | 8/1974 | Imanishi | 58/58 |
| 4,026,100 | 5/1977 | Kume et al. | 58/4 R |

*Primary Examiner*—Vit W. Miska

*Attorney, Agent, or Firm*—Birch, Stewart, Kolasch & Birch

[57] ABSTRACT

A calendar mechanism for timepieces comprising an annular date dial, an annular month dial provided outside the date dial, an auxiliary lever provided on the date dial having a pawl portion, an additional driving member adapted to be rotated one full turn every 24 hours, and cam means provided on the month dial, which biases the auxiliary lever toward the additional driving member to engage the pawl portion of the auxiliary lever with the driving member in the end of the even months, whereby the date dial may be driven two steps by operation of the usual driving means and the operation of the additional driving member in the end of the even month.

6 Claims, 4 Drawing Figures

CALENDAR MECHANISM FOR TIMEPIECES

BACKGROUND OF THE INVENTION

The present invention relates to a calendar mechanism for timepieces, and more particularly to a calendar mechanism including an automatic correcting device for the varying lengths of month.

The conventional calendar mechanism of the watch comprises an annular date dial bearing the date indications, i.e. the dates from "1" to "31" one of which can be observed through the date window provided in the watch dial and a finger for driving the date dial. The date dial is provided with a toothing on the inner side thereof and the finger is secured on the date driving wheel which is adapted to be rotated one turn for every 24 hours. The finger is adapted to be brought into operative engagement with one of the teeth of the date dial during one complete revolution thereof to thereby index the date dial one step. In such a calendar watch, the date changes necessarily from date indication "30" to "31" irrespective of length of month. Accordingly, it is necessary to operate manually the date correcting device to drive the date dial from "31" to "1" at the end of the even month. In order to remove such trouble of manual operation, there has been provided an automatic correcting device which is adapted to index the date dial two days at night of 30th day of the even month to bring the indication "1" into the date window at the beginning of the next month.

The conventional automatic correcting device comprises a month disk provided with a cam on the periphery thereof and an auxiliary pawl pivotally mounted on the date dial which may be projected by the cam at the end of the even month for operative engagement with the finger on the date dial driving wheel, whereby the date dial may be indexed two days at the end of the even month. Such an automatic correcting device is not practical, because mechanism for actuating the auxiliary pawl by the cam is of complex construction and increases the thickness of the watch on the other hand resulting the smaller indication of month.

SUMMARY OF THE INVENTION

It is the object of the present invention to provide an automatic correcting device which is of comparably simple construction and may provide a calendar mechanism without resulting in much increase of thickness thereof.

In accordance with the present invention, the calendar mechanism comprises an annular date dial adapted to be driven one step every 24 hours, an annular month dial provided outside the date dial and adapted to be driven one step during the rotation of the date dial between the indications "31" and "1," an auxiliary lever provided on the date dial, an additional driving member adapted to be rotated one full turn every 24 hours, and a cam means provided on the month dial. The auxiliary lever and cam means are so arranged that the auxiliary lever is biased by the cam means toward the additional driving member in the end of the even month, so that the pawl portion of the auxiliary lever is positioned in the path of the additional driving member, whereby the date dial may be driven additionally one step by the member.

These and other objects and features of the present invention will become fully apparent from the following detailed description in conjunction with the accompanying drawings.

DESCRIPTION OF THE PREFERRED EMBODIMENTS

Figure 1:
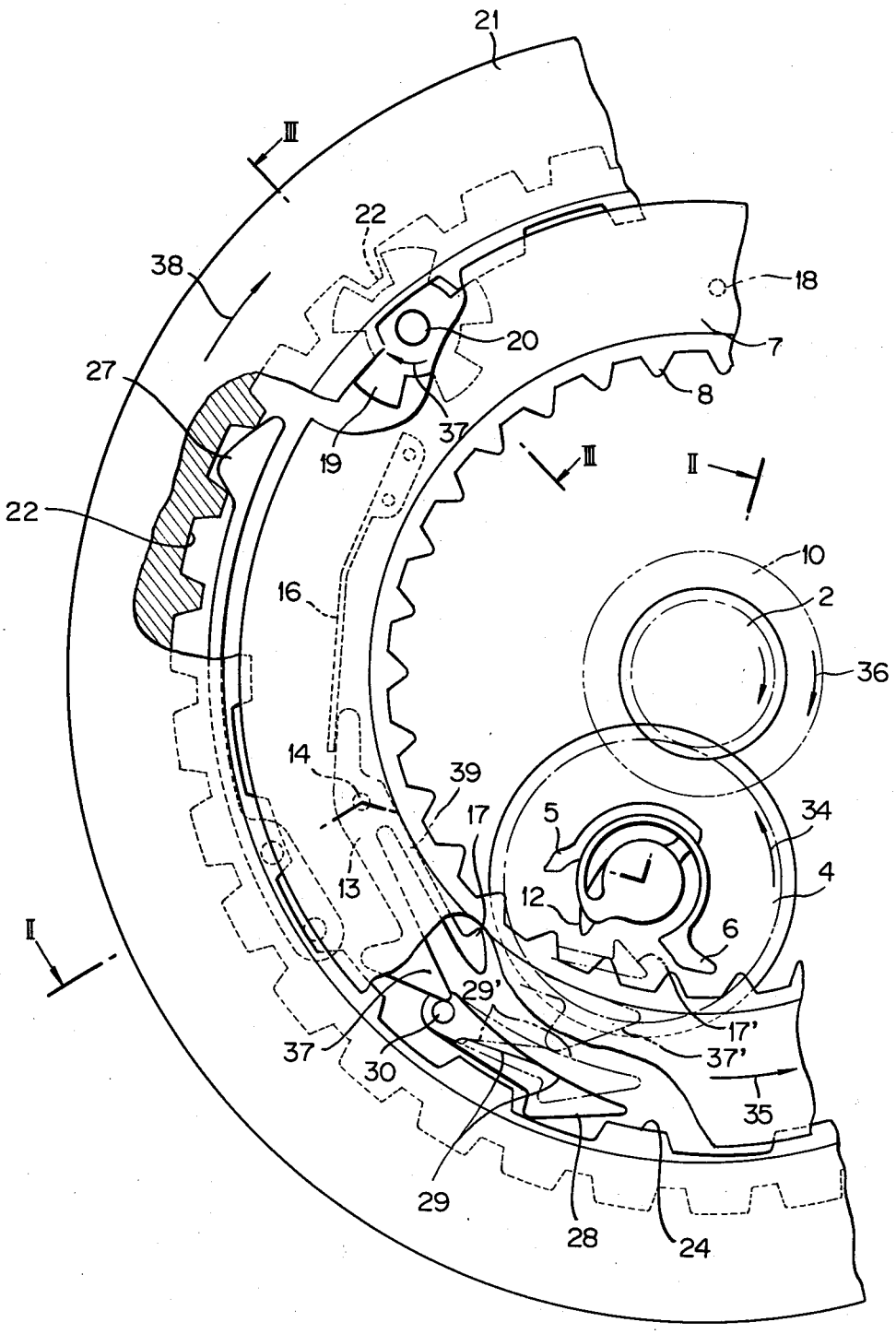
FIG. 1 is a plan view showing a calendar mechanism of a wristwatch made in accordance with the present invention.

Referring to the drawings, numeral 1 is a base plate, 2 is an hour wheel and 3 is a calendar plate for the calendar mechanism. A date dial driving wheel 4 is pivotally mounted on a pin 4a secured to the base plate 1 and is engaged with the hour wheel 2, so that it may be rotated by the hour wheel 2 one full turn for every 24 hours. On the pin 4a are pivotally mounted fingers 5, 6 and an additional finger 12 which are integrated with each other and the lowermost finger 5 is secured to the wheel 4, whereby these fingers may be rotated together with the wheel 4. The finger 5 is adapted to be engaged with toothing 8 of an annular date dial 7 during one revolution of the wheel 4 to drive the date dial one step every 24 hours. The date dial 7 is coaxial with center of the watch and rotatably mounted on the calendar plate 3 and slidably secured thereto by tabs 9. The finger 6 is adapted to be engaged with a star wheel 10 integrated with a week day dial 11 to rotate it one step every 24 hours. The date dial 7 and the week dial 11 are positioned at every indicating positions by not shown jumper springs, respectively.

Figure 2:
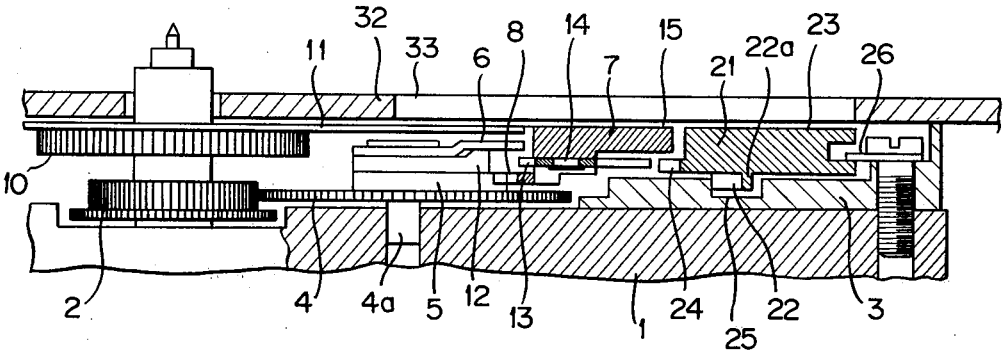
FIG. 2 is a sectional view taken along line II—II of FIG. 1.
Figure 3:
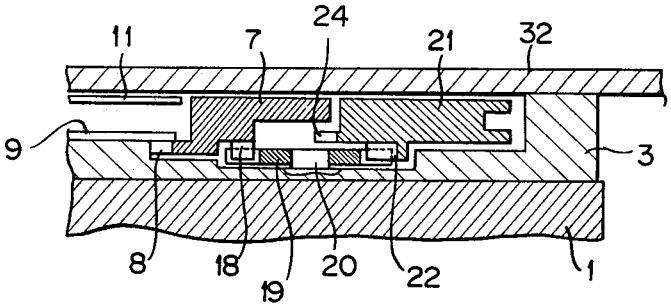
FIG. 3 is a sectional view taken along line III—III of FIG. 1, and, FIG. 4 is a sectional view similar to FIG. 2 and especially showing a control lever.

There is provided a space for an auxiliary lever 13 between the date printing surface 15 and the toothing 8 of the date dial 7. The auxiliary lever 13 is pivotally mounted on a pin 14 secured to the date dial 7 and biased by a spring 16 in the clockwise direction, so that the pawl portion 17 of the auxiliary lever is maintained in the retracted position as shown in FIG. 1. Outside the date dial 7, an annual month dial 21 is rotatably provided on the calendar plate 3. The month dial is provided with an annular projection 22a on the underside thereof and a toothing 22 on the inner side of the annular projection as shown in FIG. 2. The annular projection 22a is slidably engaged with an annular groove 25 provided on the calendar plate 3. Tabs 26 provided on the calendar plate 3 slidably engage annular groove of the periphery of month dial 21, whereby the month dial is rotatably maintained on the calendar plate. The circumferential portion of the month dial is maintained by a jumper spring 27 engaged with toothing 22. In some cases, it is possible that the tabs 26 is provided to position above the hereinafter described cam 24 of the month dial to thereby maintain it. The toothing 22 engages a month dial driving wheel 19 pivotally mounted on a pin 20, and the wheel 19 is adapted to be engaged with a pin 18 provided on underside of the date dial 7 at the end of month. Month indications of a suitable period of years, for example, three years are preferably printed on the indicating surface 23 of the month dial 21. It will be seen that number of teeth of the toothing 22 is equal to the number of the printed months.

The cam 24 comprises a series of protrusions and indentations, the protrusions corresponding to the even months and the indentations corresponding to the odd months. A control lever 28 having a cam surface 29 is pivotally mounted on a pin 30 secured to the calendar plate 3 adjacent the cam 24. It will be seen that the month dial driving wheel 19, jumper spring 27 and control lever 28 are positioned on the lower portion 31 of the calendar plate 3. As shown in FIG. 2, watch dial 32 is provided with a window 33 for date, week day and month indications.

Figure 4:
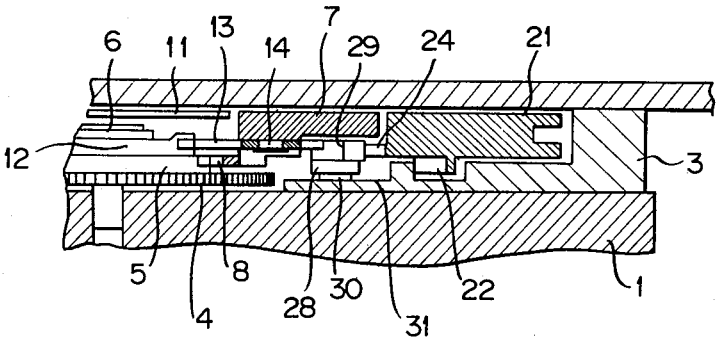

In operation, the wheel 4 is driven one full turn every 24 hours in the direction of the arrow 34 in FIG. 1, so that the date dial 7 and week day dial 11 may be driven one step every 24 hours in the directions 35 and 36, respectively. In the even month, the control lever 28 engages the protrusion of the cam 24, so that the control lever is moved to the inwardly projected position shown by dotted line in FIG. 1. When 30th day comes around, the auxiliary lever 13 reaches to the control lever 28, so that the tapered portion 37 of the auxiliary lever engages the projected cam surface 29'. Consequently, the auxiliary lever 13 is pivoted counter-clockwise by the cam surface 29' to the dotted line position 17' and 37', of which projected pawl 17' is in the path of the finger 12. It should be noted that the cam surface 29 is raised from the surface of the control lever 28, so that the tapered portion 37 may engage the cam surface without engaging other part of the control lever (FIG. 4).

In the night of 30th day, the additional finger 12 engages the projected pawl 17' to drive the date dial 7 one step and further the finger 5 engages a tooth of the toothing 8, as usual, to drive the date dial one more step. Thus, the date dial 7 is driven two steps at the night of 30th day, thereby bringing indication "1" into the window 33 at the beginning of the next month. During the rotation of the date dial 7 from "31" to "1," the pin 18 of the dial 7 engages the wheel 19 to rotate the month dial 21 one step in the direction of the arrow 38, whereby month indication in the window 33 changes to the next month indication.

In the odd months, the control lever 18 engages the indentation of the cam 24 so that the lever is in the retracted position as shown in FIG. 1 by the solid line. Therefore, the auxiliary lever 13 do not so much project inwardly as in the even month. Thus, the finger 12 does not engage the pawl 17 and hence the date dial is driven one step by the finger 5 bringing the date indication "31" into the window 33.

In the above described embodiment, the date dial is driven by the finger 12 additionally provided in the correcting device prior to the operation of the usual date dial driving finger 5. However, it is possible to drive the date dial with the finger 5 before the finger 12 by modifying the shape of each member. It will be noted that the pawl portion 17 of the auxiliary lever 13 is provided on the end of the resilient arm 39, this is a design for the purpose of preventing the finger 12 and the lever 13 from damaging due to butting against each other which arises at the manual correcting operation in the end of month, where the pawl portion 17 is located near the finger 12. If the date dial 7 or the month dial 21 is rotated by manual correcting operation, the pawl portion 17 will engage the finger to push it. At that time, the resilient arm 39 yields to the pushing engagement, whereby breakdown of the members may be prevented. Instead of the safety mechanism by the resilient arm 39, resilient portion may be provided in the arm of the finger 12 so that the finger may be retracted by the pushing engagement with the pawl portion 17.

It will be seen that the control lever 28 may be omitted by modifying the auxiliary lever 13 and the cam 24 of the month dial 21 so that both engages directly. It should be noted that it is necessary to correct manually the date and day at the end of February in accordance with this correcting mechanism, but manual operation once a year will not cause trouble to the user.

Although the manual date-day correcting device is not illustrated, it will be understood that any suitable conventional device may be employed in this calendar mechanism, and the month indication changes to the next month indication when the date indication "31" changes to "1" by manual correcting operation.

From the foregoing it will be understood hat the present invention provides a calendar mechanism which is of simplified construction and which may be manufactured in thin device, since the annual month dial is not superimposed on the date dial, but disposed outside of it. Further, it will be observed that the annular month dial may provide a wide month indicating surface convenient for bearing month indicating letters or numbers, which will make it possible to select the position of the month indicating window according to various designs.

What is claimed is:

1. A calendar mechanism for timepieces comprising an annular date dial coaxial with the center of the timepiece and having a toothing, an annular month dial provided outside said date dial having a toothing, a driving member adapted to engage the toothing of said date dial for driving it one step every 24 hours, an auxiliary lever provided on said date dial having a pawl portion, an additional driving member adapted to be rotated one full turn every 24 hours, a month dial driving device for driving said month dial one step during the rotation of said date dial between the indications "31" and "1," and cam means provided on said month dial to bias said auxiliary lever toward said additional driving member to engage the pawl portion of the auxiliary lever with said additional driving member in the end of the even month, whereby said date dial may be driven two steps in the end of the even month by said driving member and said additional driving member.

2. A calendar mechanism in accordance with claim 1, in which said auxiliary lever is provided in the space provided between the date indicating surface and the underside surface of said date dial.

3. A calendar mechanism in accordance with claim 1 in which said driving member and additional driving member are integral with each other and adapted to be rotated one full turn every 24 hours.

4. A calendar mechanism in accordance with claim 1, in which said pawl portion is provided on the end of resilient arm formed on the auxiliary lever.

5. A calendar mechanism in accordance with claim 1, in which said month dial driving device comprises a projected pin on the date dial, a wheel engaged with a toothing of the month dial and engageable with said projected pin during the rotation of said date dial between the indications "31" and "1."

6. A calendar mechanism for timepieces comprising an annular date dial coaxial with the center of the timepiece and having a toothing, an annular month dial provided outside said date dial having a toothing, a driving member adapted to engage the toothing of said date dial for driving it one step every 24 hours, an auxiliary lever provided on said date dial having a pawl portion, an additional driving member adapted to be rotated one full turn every 24 hours, a month driving device for driving said month dial one step during the rotation of said date dial between the indications "31" and "1," cam means provided on said month dial, and a control lever engaging said cam means and adapted to be engaged with said auxiliary lever to bias the auxiliary lever toward said additional driving member to engage the pawl portion of the auxiliary lever with said additional driving member in the end of the even month, whereby said date dial may be driven two steps in the end of the even month by said driving member and said additional driving member.

* * * * *